US009587567B2

(12) United States Patent
Mahadevan et al.

(10) Patent No.: US 9,587,567 B2
(45) Date of Patent: Mar. 7, 2017

(54) SELECTIVE CYLINDER DEACTIVATION APPARATUS AND METHOD FOR HIGH POWER DIESEL ENGINES

(71) Applicant: Cummins Inc., Columbus, IN (US)

(72) Inventors: Boopathi Singalandapuram Mahadevan, Columbus, IN (US); Chandan Mahato, Columbus, IN (US); John L. Hoehne, Columbus, IN (US); Ian W. McGiffen, Scipio, IN (US)

(73) Assignee: CUMMINS INC., Columbus, IN (US)

( * ) Notice: Subject to any disclaimer, the term of this patent is extended or adjusted under 35 U.S.C. 154(b) by 98 days.

(21) Appl. No.: 14/320,061

(22) Filed: Jun. 30, 2014

(65) Prior Publication Data

US 2015/0377171 A1 Dec. 31, 2015

(51) Int. Cl.

| | |
|---|---|
| ***F02D 17/02*** | (2006.01) |
| ***F02D 41/00*** | (2006.01) |
| ***F02D 41/38*** | (2006.01) |

(52) U.S. Cl.

CPC ..... *F02D 17/02* (2013.01); *F02D 41/0082* (2013.01); *F02D 41/0087* (2013.01); *F02D 41/38* (2013.01); *F02D 2200/0602* (2013.01); *F02D 2200/101* (2013.01); *F02D 2200/1002* (2013.01); *F02D 2250/36* (2013.01); *F02D 2250/38* (2013.01)

(58) Field of Classification Search

CPC .... F02N 17/02; F02N 41/30; F01N 2560/026; Y02T 10/24; Y02T 10/44; Y02T 10/47

USPC ..... 123/294, 295, 299–305; 701/102–105; 60/285–287, 301

See application file for complete search history.

(56) References Cited

U.S. PATENT DOCUMENTS

| | | | |
|---|---|---|---|
| 5,195,485 | A | 3/1993 | Jensen et al. |
| 5,826,563 | A | 10/1998 | Patel et al. |
| 6,009,857 | A | 1/2000 | Hasler et al. |
| 6,405,705 | B1 | 6/2002 | Dunsworth et al. |

(Continued)

OTHER PUBLICATIONS

Jääskeläinen, Hannu. "Diesel Fuel Injector Nozzles." DieselNet Technology Guide >> Fuel Injection for Clean Diesel Engines. www.DieselNet.com. Copyright © Ecopoint Inc. Revision Feb. 2011. 2 pages.

(Continued)

*Primary Examiner* — John Kwon
*Assistant Examiner* — Johnny H Hoang
(74) *Attorney, Agent, or Firm* — Faegre Baker Daniels LLP

(57) ABSTRACT

Various embodiments relate to a method of operating an engine system with injectors having nozzle sac volume. The engine system may be a four-stroke, high power engine having a high-pressure common-rail injection system. A number of engine cylinders to fire is selected based on a fuel injection quantity per selected engine cylinder such that a nitrogen oxides ($NO_x$) emission is less than a first predetermined threshold and a smoke value is less than a second predetermined threshold. The fuel injection quantity per cylinder may be higher than a nominal fuel injection quantity to improve fuel injector spray characteristics. The exhaust can be mixed with fresh air blowout from deactivated cylinders to further reduce smoke value. The engine system is operated with a firing pattern for the selected number of cylinders to fire.

24 Claims, 9 Drawing Sheets

(56) References Cited

U.S. PATENT DOCUMENTS 6,823,835 B2 11/2004 Dunsworth et al.
6,834,497 B2 * 12/2004 Miyoshi ..... F01N 3/0842 60/276
7,073,488 B2 7/2006 Hasler et al.
7,117,078 B1 * 10/2006 Gangopadhyay ... F02D 41/1454 123/672
2001/0015192 A1 * 8/2001 Urushihara ..... F02D 13/0211 123/299
2001/0056322 A1 * 12/2001 Yoshizawa ..... F02B 1/12 701/104
2005/0222748 A1 * 10/2005 Naik ..... F02D 41/0275 701/103
2007/0034188 A1 * 2/2007 Duffy ..... F02D 41/3035 123/299
2009/0164104 A1 * 6/2009 Wermuth ..... F02D 13/0265 701/105
2010/0305833 A1 * 12/2010 Matsunaga ..... F02D 35/025 701/105
2011/0000459 A1 1/2011 Elsaeser
2011/0160982 A1 * 6/2011 Kumar ..... F02D 41/0025 701/103
2011/0288741 A1 * 11/2011 Schaffeld ..... F02B 33/34 701/102
2012/0123662 A1 * 5/2012 Heverley, III ..... F02D 41/345 701/101
2012/0143479 A1 * 6/2012 Nada ..... F02D 41/3029 701/104
2013/0000277 A1 1/2013 Uzkan et al.
2013/0006497 A1 1/2013 Silvers et al.
2013/0024097 A1 * 1/2013 Nada ..... F02D 41/403 701/104
2014/0034014 A1 2/2014 Blythe et al.

OTHER PUBLICATIONS

International Search Report and Written Opinion dated May 11, 2015 in PCT/US2015/034010.

* cited by examiner

SELECTIVE CYLINDER DEACTIVATION APPARATUS AND METHOD FOR HIGH POWER DIESEL ENGINES

TECHNICAL FIELD

The present disclosure relates to diesel engines. In particular, this disclosure relates to operating an injection system to control combustion characteristics in high power diesel engines.

BACKGROUND

High power diesel engines must meet increasingly stringent emission regulations for smoke values (i.e. white smoke or black smoke) and nitrogen oxides ($NO_x$) values in various jurisdictions, such as EPA Tier 4 requirements in the United States. High power diesel engines often utilize high injection pressure in order to meet these requirements. At the same time, high power diesel engines are designed with large bore cylinders to produce high power output. The large bore cylinders are typically paired with injectors having nozzle sac volume to mitigate unacceptable smoke values at typical engine operating points (i.e. a typical engine speed and load) and high-pressure fuel injection systems to mitigate $NO_x$ emissions.

A typical high power diesel engine responds to low engine load by delivering a lower quantity of fuel to reduce power output. With lower quantities of fuel, injectors with large injector hole diameters and nozzle sac volume are difficult to control, resulting in poor combustion characteristics, such as poor fuel spray characteristics leading to increased smoke value.

Adding an engine exhaust aftertreatment system, such as a diesel particulate filter (DPF), to a high power diesel engine system can reduce smoke value. However, DPFs add cost, complexity, and potential for failure. For example, to prevent plugging and failure, a DPF requires a regeneration process, which requires higher fuel consumption, complex control algorithms, and more sensors.

Instead of an aftertreatment system, altering nozzle geometry, such as removing or reducing nozzle sac volume from the injectors, can improve fuel spray characteristics at lower engine loads. However, without nozzle sac volume, injectors would experience excessive nozzle cavitation and severely reduced nozzle life due to high pressure fueling typically used to meet $NO_x$ emission requirements.

There exists a continuing need to reliably reduce smoke value for high power diesel engines with nozzle sac volume, especially for low engine load conditions.

SUMMARY

Various embodiments of the disclosure relate to a method of operating an engine system. One embodiment of the method comprises detecting one or more engine system parameters, wherein the one or more engine parameters includes at least one of engine load and engine speed; selecting a number of engine cylinders to fire and a fuel injection quantity per selected engine cylinder in response to the one or more engine system parameters such that a nitrogen oxides ($NO_x$) emission is less than a first predetermined threshold and a smoke value is less than a second predetermined threshold; and operating the engine system with the selected number of engine cylinders to fire at the fuel injection quantity per selected engine cylinder. The engine system parameters can comprise, but are not limited to, engine speed, engine load, instantaneous air-fuel ratio of firing engine cylinders, a fuel injection quantity versus engine speed curve defined in a controller, exhaust port temperature, engine operating state, and which module controls engine operation.

In some embodiments, selecting a number of engine cylinders to fire and a fuel injection quantity includes determining a requested engine power; calculating an estimated $NO_x$ emission and an estimated smoke value; determining the first and second thresholds; determining available numbers of cylinders to fire; determining acceptable cylinder operating points based on the estimated $NO_x$ emission, estimated smoke value, first and second thresholds, and available firing patterns; and selecting a cylinder operating point and corresponding number of cylinders to fire and fuel injection quantity to meet the requested engine power.

In various embodiments, the selected number of engine cylinders is less than a total number of engine cylinders such that a complementary number of engine cylinders are deactivated, and the method may further include calculating an estimated $NO_x$ emission and an estimated smoke value based on fresh air blow out from the deactivated engine cylinders.

In some further embodiments, the selected fuel injection quantity per selected engine cylinder is higher than a nominal fuel injection quantity per engine cylinder, corresponding to firing all cylinders, such that injector spray characteristics for the selected engine cylinders are improved.

In yet further embodiments, the method further includes selecting a firing pattern for the engine cylinders to fire and operating the engine system using the selected firing pattern.

In some embodiments, the engine system includes a high-pressure, injection system with high-capacity fuel injectors each having a nozzle sac volume adapted to produce acceptable smoke values at a typical engine operating point. In various embodiments, the engine speed is higher than an idle engine speed.

Various embodiments of the disclosure relate to a high power engine system including means for selecting a number of engine cylinders to fire and a fuel injection quantity per selected engine cylinder in response to the one or more engine system parameters such that a nitrogen oxides ($NO_x$) emission is less than a first predetermined threshold and a smoke value is less than a second predetermined threshold. In further embodiments, the means including means for responding to dynamic changes in the one or more engine system parameters, including engine speed.

Further embodiments of the disclosure relate to a controller for an engine system. The controller comprises an engine description module configured to receive one or more engine system parameters, wherein the one or more engine parameters includes at least one of engine load and engine speed; a combustion control module configured to provide control signals to components of the engine system, including a fuel injection system; a processor coupled to the engine description module and the combustion control module, the processor configured for: selecting a number of engine cylinders to fire and a fuel injection quantity per selected engine cylinder in response to the one or more engine system parameters such that a nitrogen oxides ($NO_x$) emission is less than a first predetermined threshold and a smoke value is less than a second predetermined threshold; and a data storage module coupled to the processor. The data storage module is configured to store tables and configured to send and receive data to the processor, and the tables include at least the first and second predetermined thresholds.

Various embodiments of the disclosure relate to a method of operating an engine cylinder. One embodiment of the method comprises determining whether to fire an engine cylinder in response to one or more engine system parameters; determining a fuel injection quantity for the engine cylinder such that a nitrogen oxides ($NO_x$) emission for the engine cylinder is less than a first predetermined threshold and a smoke value for the engine cylinder is less than a second predetermined threshold; and injecting the fuel quantity into the engine cylinder. In some embodiments, determining the fuel injection quantity is based on a selected number of cylinders to fire and a requested engine power.

Figure 1:
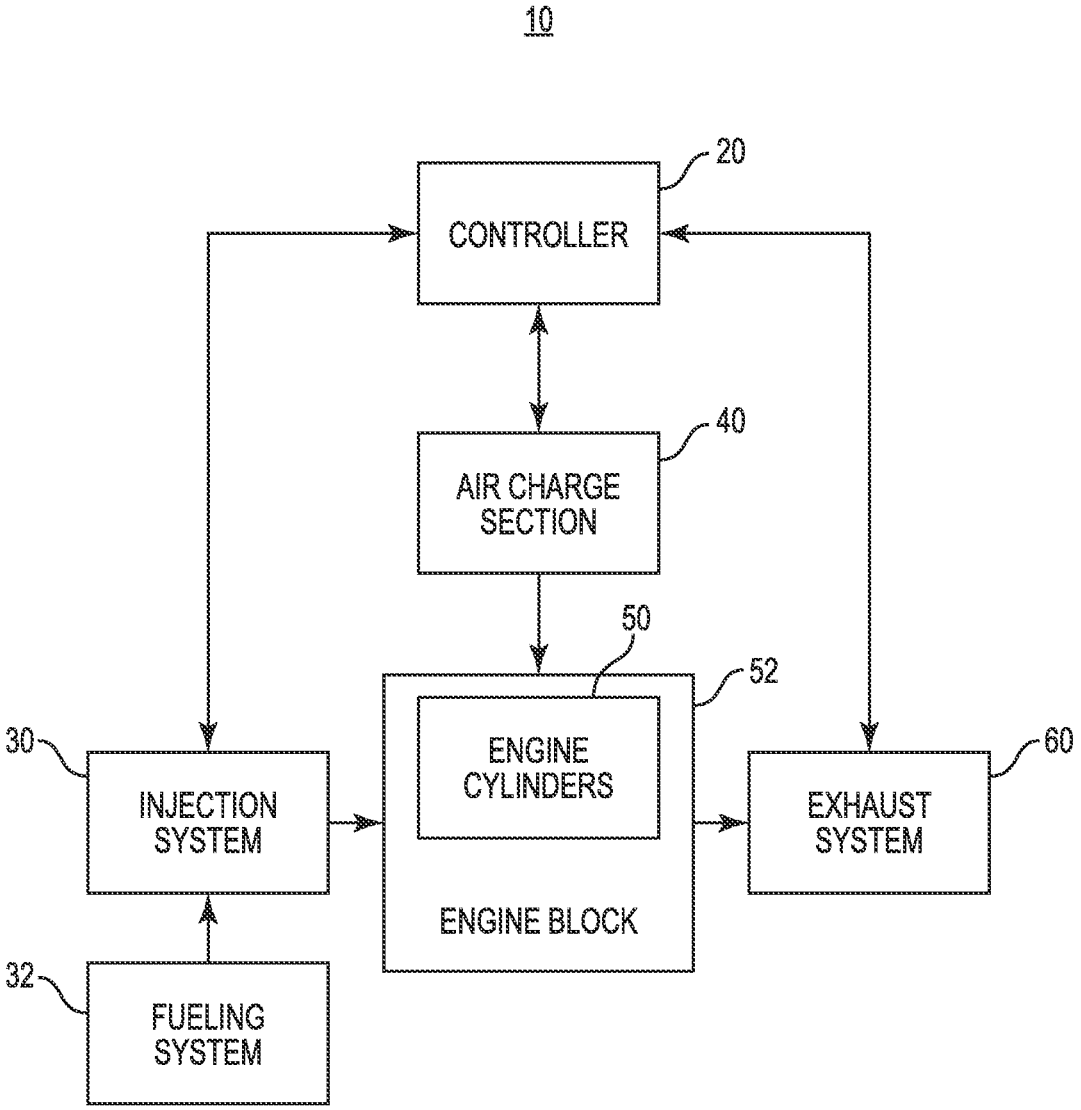
FIG. 1 is a schematic illustration of an engine system, according to some embodiments of the disclosure.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

FIG. 1 is a schematic illustration of an engine system 10, according to some embodiments. Engine system 10 is adapted to mitigate emissions at low load conditions for a requested engine power. As shown, the engine system 10 includes a controller 20, an engine block 52 including engine cylinders 50, an injection system 30 adapted for pressurizing the fuel from fueling system 32 and delivering the fuel into one or more engine cylinders 50, an air charge section 40 for delivering air into the engine cylinders for combustion, and an exhaust system 60 adapted for receiving combusted air and fuel (i.e. exhaust). To help reduce emissions, the air charge section 40 may include an intake modification system (not shown), such as a turbocharger or exhaust gas recirculation system (EGR). In addition, to help reduce emissions, the exhaust system 60 may include a diesel particulate filter (DPF) or selective catalytic reduction (SCR) system.

In some embodiments, the engine system 10 is designed and configured to operate at a typical operating point (i.e. an engine load and an engine speed in a typical operating range) where emissions are mitigated to acceptable levels. A typical operating point often has a typical engine speed above an engine idle speed. In some embodiments, when the engine load is substantially below or above a range of typical operating point engine loads, emissions become unacceptably high.

The controller 20 is configured to select a number of cylinders to fire in response to the one or more engine parameters detected. In some embodiments, the controller 20 is operatively coupled to sensors in the injection system 30, engine block 52, and exhaust system 60, for example, to detect and monitor the one or more engine parameters. The one or more engine parameters may include, but are not limited to, engine speed, engine load, instantaneous air-fuel ratio of firing cylinders, a fuel injection quantity versus engine speed curve defined in a controller, exhaust port temperature, engine operating state, and which module controls engine operation.

In various embodiments, in response to a reduced engine load or reduced requested engine power, the controller 20 is adapted to selectively deactivate engine cylinders. When deactivating one or more cylinders, the fuel injection quantity can be increased per active engine cylinder resulting in improved combustion characteristics for similar engine speed. The fuel injection quantity, for example, may be higher than a nominal fuel injection quantity corresponding to the engine system operating with all engine cylinders firing (i.e. no deactivation). The improved combustion characteristics are capable of achieving lower smoke values for similar $NO_x$ emission. In some embodiments, the improved combustion characteristics reduce white smoke at low engine load, for example. In further embodiments, black smoke is reduced. In the deactivated cylinders, fresh air blow out can further reduce smoke value in the exhaust by increasing the ratio of air to combusted gasses in the exhaust (i.e. diluting the exhaust).

In some embodiments, the engine system 10 is configured as a four-stroke engine. In the four-stroke configuration, the controller 20 sets injection timing and fuel injection quantity for the injection system 30 toward the end of the compression stroke to initiate the power stroke (i.e. combustion). After the power stroke, the exhaust is vented out of the engine cylinder and into the exhaust system 60.

In various embodiments, engine system 10 is a high power diesel engine system suitable for use in various applications as recognized by those having skill in the art. The meaning of high power can depend on the application. In some self-driving applications, high power is defined as being capable of producing 300 horsepower or more. In some applications, high power is defined as being capable of producing 750 horsepower or more, such as in automotive or on-road applications. In some further applications, high power is defined as being capable of producing 2000 horsepower or more, such as in locomotive applications or off-road applications. Yet in further applications, high power is defined as being capable of producing 3500 horsepower or more, such as in stationary applications.

In some embodiments, to produce high power, the engine cylinders 50 are large bore cylinders with a high displacement as recognized by those having skill in the art. High displacement engine cylinders are often grouped into 8 or more cylinders, or 16 or more cylinders, in an engine block. In general, larger displacements are capable of producing more power but also require a higher fuel injection quantity. Total cylinder displacement and total number of cylinder pairs may include, but are not limited to, 15 liter (L) or more with 6 cylinders, 30 L or more with 12 cylinders, 40 L or more with 16 cylinders, and 70 L or more with 20 cylinders. Typical total cylinder displacement and total number of cylinder pairs may include, for example, 19 liters (L) and 6 cylinders, 23 L and 6 cylinders, 30 L and 6 cylinders, 38 L and 12 cylinders, 45 L and 12 cylinders, 50 L and 16 cylinders, 60 L and 16 cylinders, 78 L and 20 cylinders, 95 L and 16 cylinders, and 120 L & 20 cylinders.

In some embodiments, the injection system 30 is a high pressure fuel injection system. High pressure fuel injection can be used to reduce $NO_x$ emission by improving fuel spray characteristics into the engine cylinders 50. In various embodiments, the injection system 30 is a common-rail injection system with a high pressure fuel rail for delivering diesel fuel. In some embodiments, the fuel is pressurized in a range between 450 and 3000 bar. In various embodiments, the fuel is pressurized to 1600 bar (approximately 22,000 psi) or more. In yet other embodiments, the fuel is pressurized to 2200 bar (approximately 32,000 psi) or more. However, for some injector nozzle geometries, such as those without sufficient nozzle sac volume, high pressure fuel injection results in nozzle cavitation, excessive wear, and unacceptably high smoke values.

In some embodiments, the controller 20 is adapted to control various components of engine system 10 to operate the engine system 10. The controller 20 may be adapted to control the fuel injection system 30 to operate the engine system 10 with the selected number of cylinders to fire. In some embodiments, controller 20 is adapted to control combustion timing (i.e. engine speed) individually for each engine cylinder 50, allowing the controller to selectively fire (i.e. activate) and not fire (i.e. deactivate) individual engine cylinders. In some embodiments, operating the engine system 10 may include selecting a firing pattern and/or controlling the injection system with the selected firing pattern.

Figures 2A, 2B, 2C, 2D, 2E:
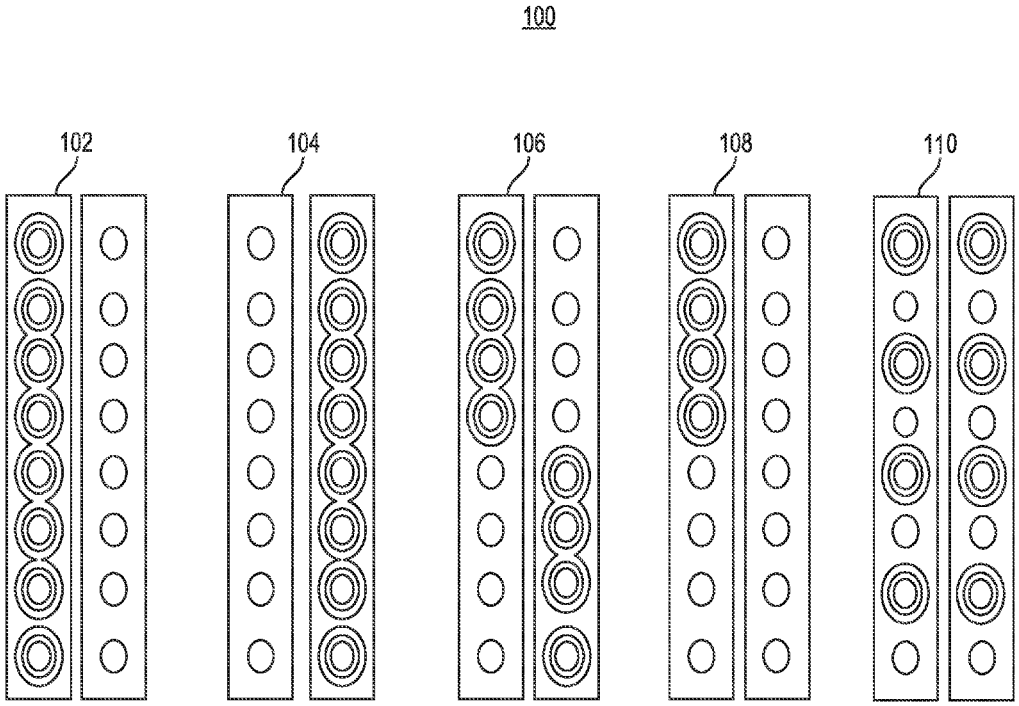
FIGS. 2A-2E are a schematic illustrations of exemplary firing patterns for use with the engine system, according to some embodiments of the disclosure.

FIGS. 2E-2D are schematic illustrations of exemplary firing patterns 100 for use with the engine system 10, according to some embodiments. Several firing patterns including selective cylinder deactivation are possible. In some embodiments, a number of cylinders are selected to fire and a complementary number of cylinders are deactivated. As shown, the firing patterns 100 include 16 total cylinders with active cylinders indicated by three rings and deactivated cylinders indicated by a single ring.

For example, as shown in FIG. 2A, when 8 cylinders are selected to fire, a first half of the cylinders are deactivated leaving a second half of the cylinders active and firing, as shown by pattern 102. Alternatively, as shown in FIG. 2B, the second half of the cylinders can be deactivated leaving the first half of the cylinders active and firing as shown by pattern 104. In some embodiments, the firing pattern can change during operation, which may advantageously balance heat dissipation in the engine block 52. For example, the firing pattern may alternate between pattern 102 and pattern 104 after a predetermined or calculated, by the controller, interval of time.

FIG. 2C shows half of the total number of cylinders firing in yet another pattern 106 where a first side of the first half and a second side of the second half are active. Such a firing pattern may advantageously dissipate heat. In some embodiments, as shown in FIG. 2D, when only a quarter of the cylinders are selected to fire, a firing pattern 108 may be selected. In some embodiments, pattern 106 may be used when a first reduced engine load is detected, and pattern 108 may be used when a second even further reduced engine load is detected. FIG. 2E shows a firing pattern 110 according to various embodiments, wherein the fired cylinders are spaced pairs.

Though not shown here, different patterns and combinations of firing patterns with other total numbers of cylinders are contemplated in this disclosure. In some embodiments, available firing patterns depend on engine parameters and/or predetermined data. For example, the firing pattern selected can depend on engine speed and engine load.

Figure 3:
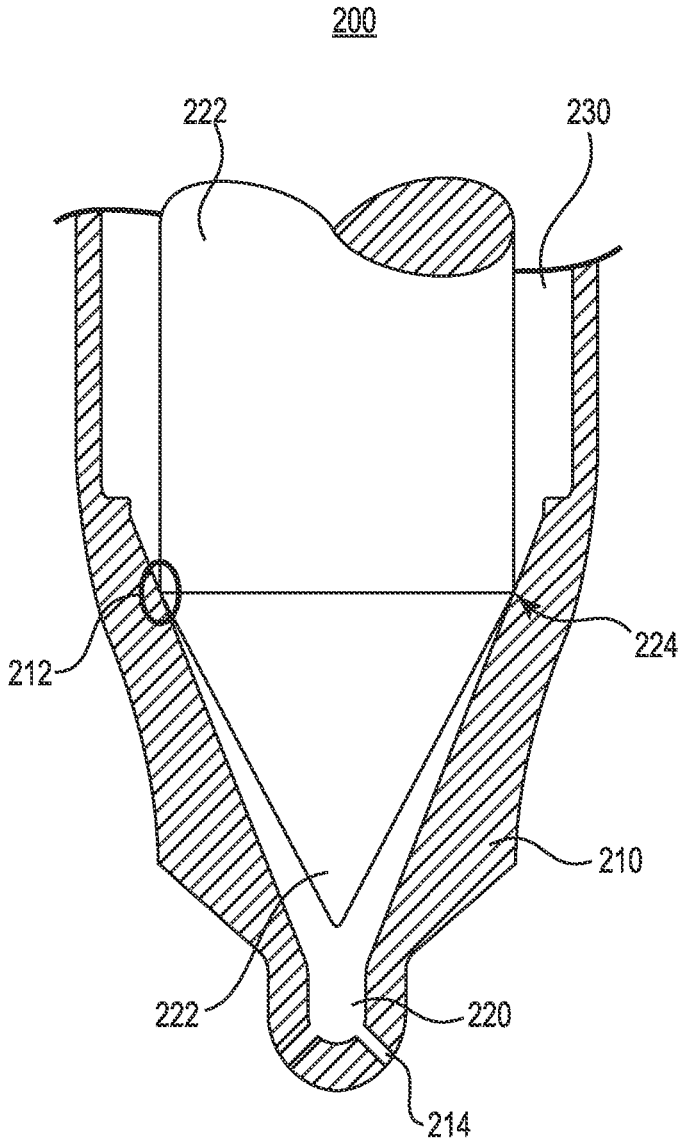
FIG. 3 is a schematic illustration of a cross-sectional view of an exemplary injector having nozzle sac volume for use in the engine system, according to some embodiments of the disclosure.

FIG. 3 is a cross-sectional view of an exemplary injector 200 having nozzle sac volume 220 for use in the engine system 10, according to some embodiments. The injector 200 is adapted to be placed on the head of one engine cylinder 50 to receive pressured fuel and inject the fuel at high pressure into the cylinder. In the illustrated embodiment, injector 200 includes an injector body 210 and an injector volume 230 formed in the injector body. The injector body 210 includes a seat 212 for engaging the injector needle 222 and one or more nozzle holes 214 formed in the injector body for enabling fluid communication between the injector volume 230 and the engine cylinder 50. The injector needle 222 is adapted to raise to open the injector 200 and deliver fuel, and the injector needle 222 is adapted to lower to close the injector 200 and engage the seat 212 of the injector body at the seating line 224 of the injector needle.

In some embodiments, the injector 200 is adapted to respond to the controller 50 for opening and closing the injector to deliver more or less fuel to the engine cylinder 50 at specific times during the four stroke cycle. When requested engine load is lower, the injector 200 is adapted to close quickly after opening to deliver a small quantity of fuel. The lower quantity of fuel results in poor combustion characteristics especially at high injection pressure due to poor fuel spray characteristics, such as dribbling fuel out of the nozzle instead of properly atomizing and swirling in the cylinder.

In various embodiments, the injector 200 is adapted to be left closed by the controller 50 through one or more four stroke cycles preventing fuel from entering the engine cylinder 50, and thereby selectively deactivating the cylinder while active cylinders fire.

The injector volume 230 includes a nozzle sac volume 220 adjacent to and in fluid communication with the nozzle hole 214, even when the injector is closed. In various embodiments, the nozzle sac volume 220 has a proper geometry (i.e. size and shape) for high pressure fuel injection to produce acceptable emission characteristics at a typical engine operating point. The nozzle sac volume 220 may also be adapted to reduce cavitation to prevent excessive wear at the typical engine operating point. However, the nozzle sac volume geometry is fixed.

An injector 200 with nozzle sac volume 220 behaves differently than an injector without nozzle sac volume (not shown). Both types of injectors produce lower levels of smoke value at typical operating points for which they are designed. Both types of injectors also produce high smoke value at high levels of fueling. However, combusting a lower fuel quantity in an injector 200 with nozzle sac volume 220 will increase smoke value, whereas an injector without nozzle sac volume will often reduce smoke value in response to a lower fuel quantity. By selectively deactivating cylinders, active cylinders can be delivered more fuel by injectors 200 to avoid poor combustion characteristics, such as poor fuel spray characteristics, in active cylinders.

Figure 4:
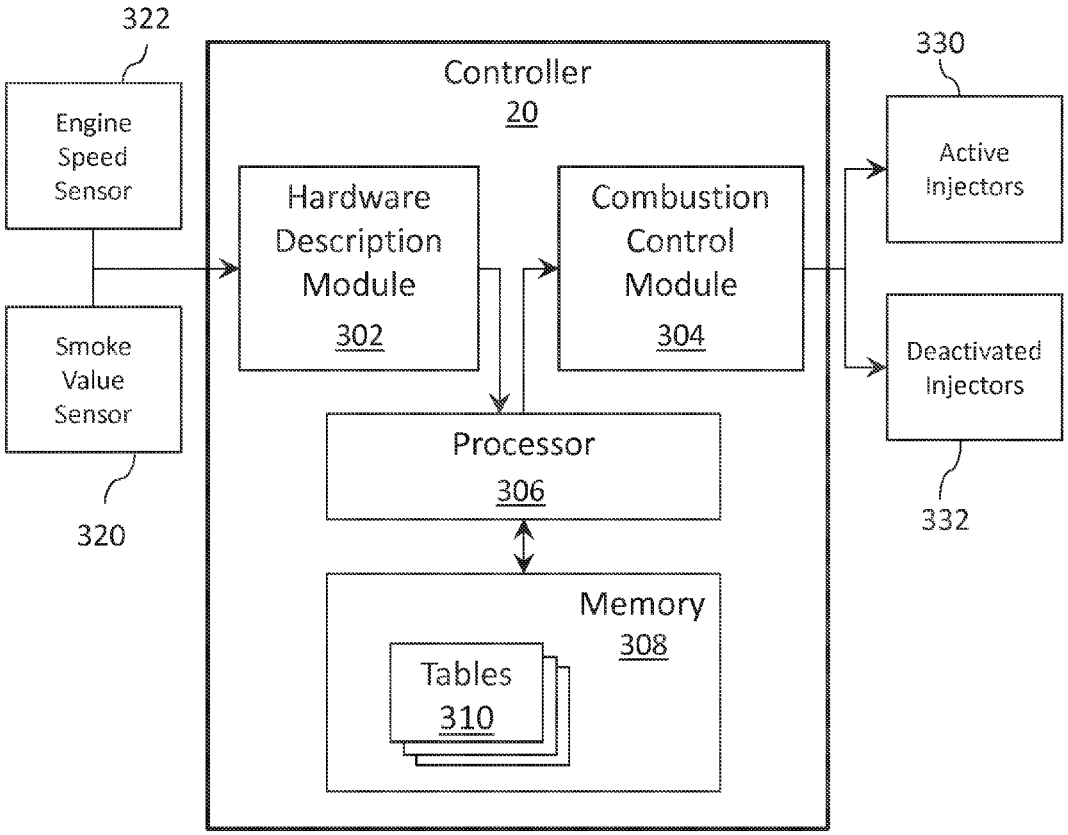
FIG. 4 is a schematic illustration of an exemplary controller for controlling the engine system, according to some embodiments of the disclosure.
Figure 5:
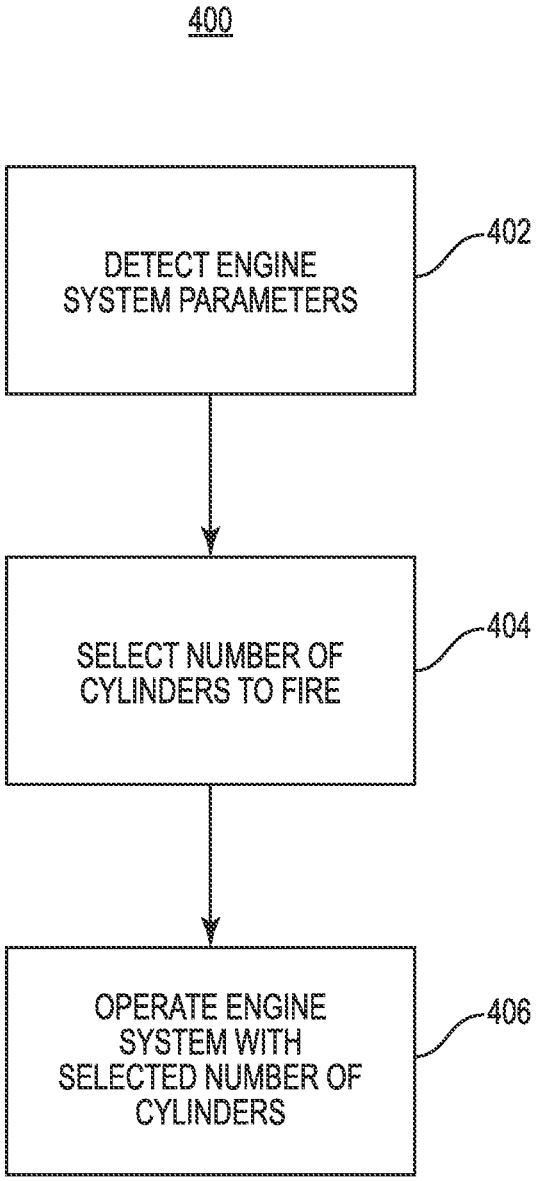
FIG. 5 is a schematic illustration of an exemplary method for operating an engine system, according to some embodiments of the disclosure.

FIG. 4 is a schematic illustration of an exemplary controller 20 for controlling the engine system, according to some embodiments. Engine controller 20 includes a hardware description module (HDM) 302, a combustion control module (CCM) 304, a processor 306, and a memory 308 (i.e. data storage module). The HDM 302 and the CCM 304 are operatively coupled to the processor 306 so that the processor can receive signals from the HDM and provide signals to the CCM. The processor 306 is also operatively coupled to memory 308 so that the processor can send and receive signals to the memory in connection with storing data. The memory optionally includes tables 310 for storing data structures.

In some embodiments, HDM 302 is operatively coupled to various components of the engine system 10, such as engine sensors disposed in the engine system 10 to detect various signal representing engine parameters. In the embodiment shown, the HDM 302 is coupled to a smoke value sensor 320 adapted to monitor smoke value of the exhaust, which may be positioned in the exhaust system 60. The HDM 302 is also coupled to an engine speed sensor 322 adapted to detect engine speed, which may be positioned on the engine block 52. Other sensors (not shown) may be operatively coupled to the HDM 302 and adapted to detect engine load, instantaneous air-fuel ratio of firing cylinders, a fuel injection quantity versus engine speed curve defined in a controller, exhaust port temperature, and engine operating state, for example.

In some embodiments, the CCM 304 is operatively coupled to various engine components in the engine system 10, such as injectors 200 to provide a signal representing the firing pattern selected. In the embodiment shown, the CCM 304 is operatively coupled to active injectors 330 corresponding to cylinders to fire and deactivated injectors 332 corresponding to cylinders to not fire. In some embodiments, the controller 20 may include various combustion control modules for controlling engine operation, such as a steady state combustion control module and a transient state combustion control module.

In some embodiments, tables 310 in memory 308 store data and provide output data as a function of input data. Input data may represent various engine parameters, such as engine speed. Output data may represent a number of cylinders to fire (i.e. activate) or a number of cylinders not to fire (i.e. deactivate). Examples of relationships between data include, but are not limited to, estimated $NO_x$ emission, estimated smoke value, and fuel injection quantity as a function of various cylinder operating points (i.e. engine speed and per cylinder torque).

In some embodiments, processor 306 is configured for selecting a number of engine cylinders to fire and a fuel injection quantity per selected engine cylinder in response to the one or more engine system parameters such that a $NO_x$ emission is less than a first predetermined threshold and a smoke value is less than a second predetermined threshold. In determining the number of cylinders to be fired, the processor may be further configured to determine a fuel quantity for a cylinder such that injector spray characteristics are improved for each fired (i.e. active) cylinder.

Some aspects of this disclosure are described in terms of sequences of actions to be performed by elements of a controller, module, a computer system, and/or other hardware capable of executing non-transient computer-readable instructions. These elements can be embodied in an engine controller of an engine system, such as an engine control unit (ECU), also described as an engine control module (ECM), or in a controller separate from, and communicating with an ECU. In some embodiments, the engine controller 20 can be part of a controller area network (CAN) in which the controller, sensor, actuators communicate via digital CAN messages. It will be recognized that in each of the embodiments, the various actions for implementing the control strategy could be performed by specialized circuits (e.g., discrete logic gates interconnected to perform a specialized function), by application-specific integrated circuits (ASICs), by program instructions (e.g. program modules) executed by one or more processors (e.g., a central processing unit (CPU) or microprocessor), or by a combination of both. All of which can be implemented in a hardware and/or a non-transient computer-readable medium of the ECU and/or other controller or plural controllers. Logic of embodiments consistent with the disclosure can be programmed, for example, to include one or more singular or multidimensional lookup tables and/or calibration parameters. The non-transient computer-readable medium can comprise a random access memory (RAM), a read-only memory (ROM), an erasable programmable read-only memory (EPROM or Flash memory), an optical fiber, a portable compact disc read-only memory (CD-ROM), or any other solid-state, magnetic, and/or optical disk medium capable of storing information. Thus, various aspects can be embodied in many different forms, and all such forms are contemplated to be consistent with this disclosure.

Figure 6:
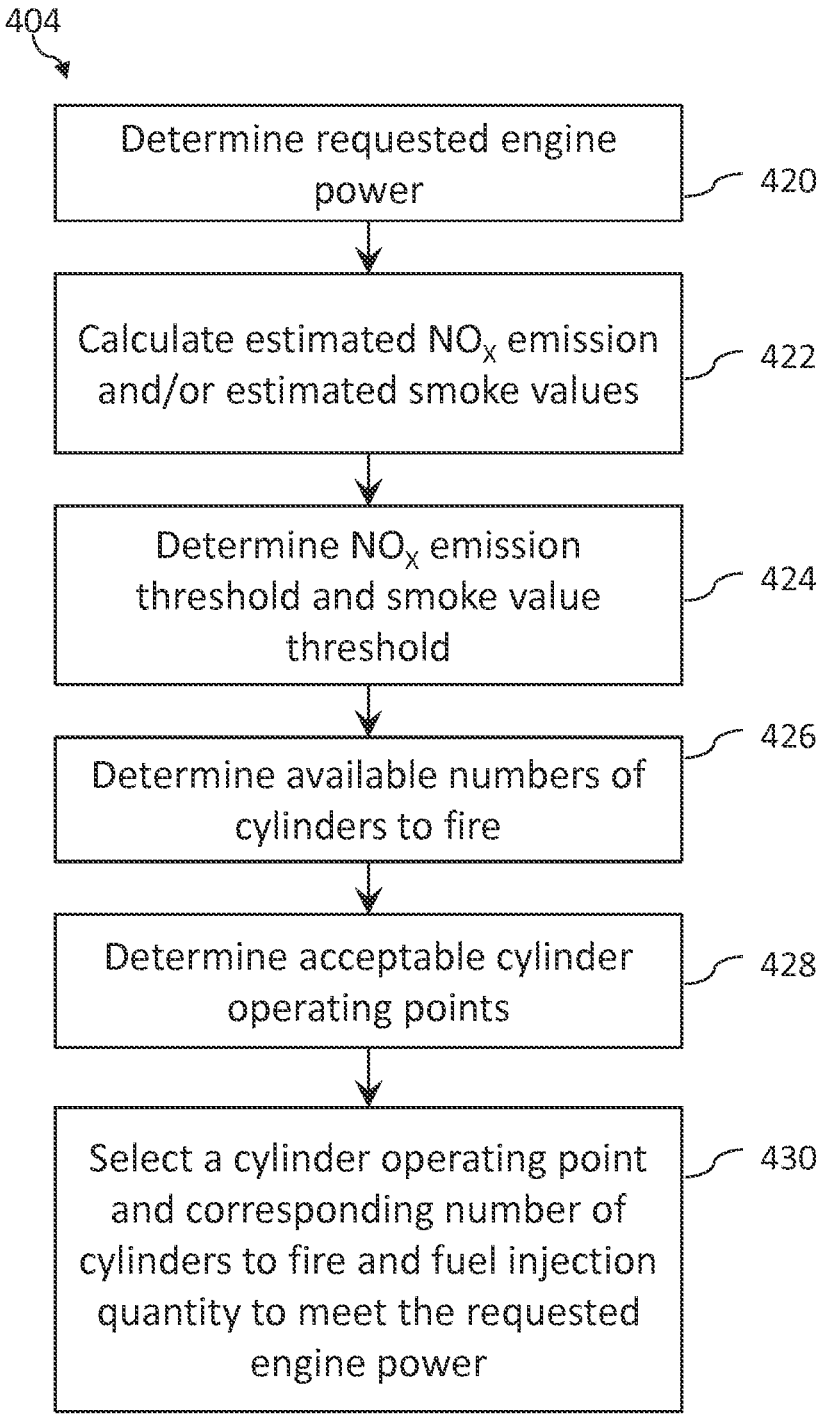
FIG. 6 is a schematic illustration showing detail of an exemplary method for selecting a number of cylinders to fire, according to some embodiments of the disclosure.
Figure 7:
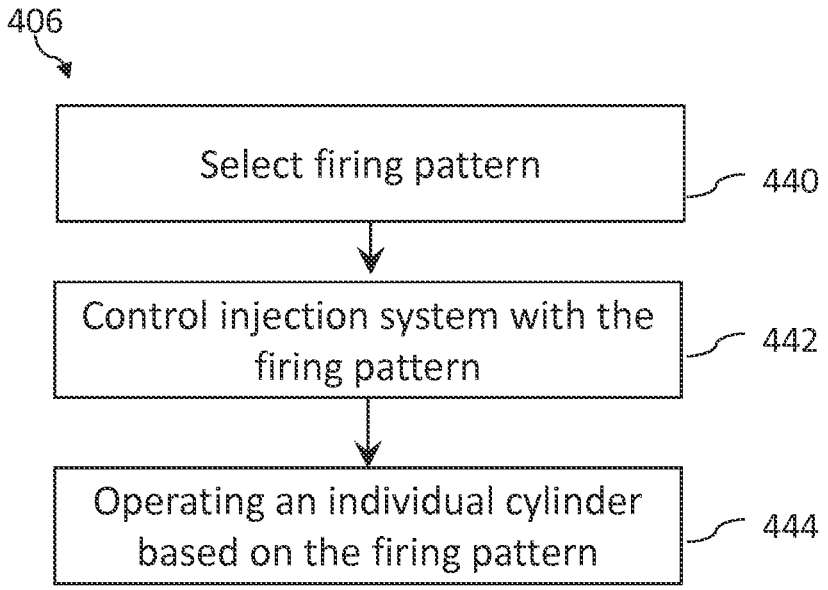
FIG. 7 is a schematic illustration showing detail of an exemplary method for operating an engine system with a selected number of cylinders, according to some embodiments of the disclosure.
Figure 8:
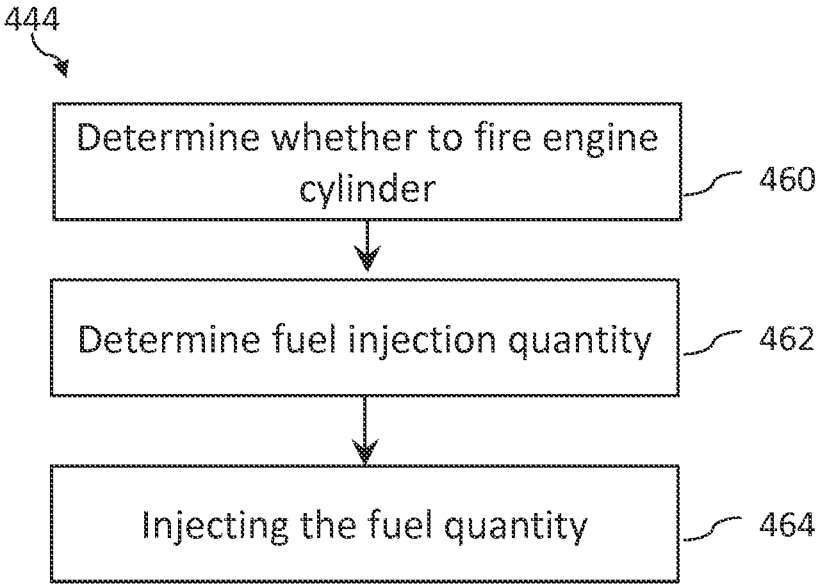
FIG. 8 is a schematic illustration showing detail of an exemplary method for operating an individual cylinder, according to some embodiments of the disclosure.

Referring now to FIGS. 5-8, FIG. 5 is a schematic illustration of exemplary method 400 for operating an engine system, according to some embodiments. FIG. 6 is a schematic illustration showing detail of exemplary method 404 for selecting a number of cylinders to fire, according to some embodiments. FIG. 7 is a schematic illustration showing detail of exemplary method 406 for operating an engine system with a selected number of cylinders, according to some embodiments. FIG. 8 is a schematic illustration showing detail of exemplary method 444 for operating an individual cylinder, according to some embodiments. One or more steps of methods 400, 404, and 406 can be carried out by any suitable controller or combination of controllers.

In step 402, engine system parameters are detected. The one or more engine parameters may include, but are not limited to, engine speed, engine load, instantaneous air-fuel ratio of firing cylinders, a fuel injection quantity versus engine speed curve defined in a controller, exhaust port temperature, engine operating state, and which module controls engine operation. The engine parameters can be detected at various stages of engine system operation. For example, the engine parameters may be detected during steady state. In some embodiments, steady state operation may include engine idling or a constant speed above idle, for example. As another example, the engine parameters may be detected during transient state operation of the engine system in which engine parameters are fluctuating, such as under acceleration or after a shift in engine load.

In some embodiments, the engine speed is higher than an idle engine speed. In various embodiments, the number of cylinders selected is less than (e.g. a subset of) the total number of cylinders. In a number of embodiments, the fuel injection quantity per cylinder is greater than a nominal fuel injection quantity per cylinder corresponding to firing all cylinders, which may result in a higher per cylinder torque.

In step 404, a number of engine cylinders to fire is selected. Optionally, in step 404, a fuel injection quantity per selected engine cylinder is also selected. The selections are made in response to the one or more engine system parameters and such that a nitrogen oxides ($NO_x$) emission is less than a first predetermined threshold and a smoke value is less than a second predetermined threshold. In step 406, the engine system is operated with the selected number of engine cylinders to fire at the fuel injection quantity per selected engine cylinder.

According to some embodiments of method 404, as shown in FIG. 6, selecting a number of engine cylinders to fire may include determining requested engine power in step 420. The requested engine power may be controlled by an operator of the engine system, for example, based on the position and movement of the accelerator pedal. In some embodiments, the requested engine power translates into a proportional engine speed.

In step 422, estimated $NO_x$ emissions and/or an estimated smoke values are calculated. In some embodiments, the estimates are determined for a range of operating points for the engine or individual cylinder. For example, the estimates may be calculated for a range of engine speeds and per cylinder torque values. The estimates may be stored in one or more tables stored in a memory for output in response to an operating point.

In step 424, $NO_x$ emission thresholds and/or a smoke value thresholds are determined. In some embodiments, the thresholds correspond to emission standards, such as EPA Tier 4 requirements, for example. In some further embodiments, the estimates are determined for a range of operating points for the engine or individual cylinder. The thresholds may be stored in one or more tables stored in a memory for output in response to an operating point.

In step 426, available numbers of cylinders to fire are determined. The available numbers represents one or more possible cylinder deactivation options for a set of cylinders. For example, available numbers for a set of 16 total cylinders may include 4, 8, and 12 cylinders to fire and 12, 8, and 4 cylinders to deactivate, respectively. In another example, the available numbers of cylinders to fire may include all of the cylinders and half of the cylinders.

In optional step 428, acceptable cylinder operating points are determined. In some embodiments, the acceptable cylinder operating points are based on operating points for available numbers of cylinders to fire capable of meeting the requested engine power. In yet further embodiments, the acceptable cylinder operating points are based on operating points that provide an estimated $NO_x$ emission and estimated smoke value less than (or up to) an $NO_x$ emission threshold and smoke value threshold, respectively. The acceptable cylinder operating points may include zero, one, or multiple operating points. If zero acceptable cylinder operating points are determined, other engine system measures may be taken to reduce $NO_x$ emission or smoke value, for example.

In step 430, a cylinder operating point is selected from the acceptable cylinder operating points (if available) to meet the requested engine power. In some embodiments, a corresponding number of cylinders to fire and/or a fuel injection quantity are also selected. The cylinder operating point, number of cylinders to fire, and fuel injection quantity may be selected based on available numbers of cylinders to fire and/or an operating point that provides an estimated $NO_x$ emission and estimated smoke value less than (or up to) an $NO_x$ emission threshold and smoke value threshold.

In various embodiments, the determinations are performed in parallel or in any order capable of selecting a number of cylinders to deactivate in order to mitigate $NO_x$ emission under the $NO_x$ emission threshold and/or mitigate the smoke value under the smoke value threshold.

According to some embodiments of method 406, as shown in FIG. 7, operating the engine system with the selected number of cylinders may include selecting a firing pattern in step 440. The firing pattern may resemble any described herein or shown in FIGS. 2A-2E, where some cylinders are deactivated for a four-stroke cycle and some cylinders are active.

In step 442, the injection system is controlled to use the firing pattern selected. In some embodiments, the injection system may be a common-rail injection system that is the primary mechanism for controlling combustion characteristics. The injection system controls combustion characteristics by selectively activating or deactivating individual cylinders to create a firing pattern. Other than activating and deactivating, the injection system may also control combustion characteristics by controlling combustion timing and fuel injection quantity. In step 444, an individual cylinder is operated based on the firing pattern.

According to some embodiments, as shown in FIG. 8, operating an individual engine cylinder based on the firing pattern may include determining whether to fire the engine cylinder in step 460. When the cylinder is determined to not be fired based on the firing pattern, the cylinder is deactivated. When the cylinder is determined to be fired based on the firing pattern, other steps may be taken to determine optimal timing.

In step 462, the fuel injection quantity is determined. The fueling quantity may be based on or be the same as the fuel injection quantity determined in step 430. The quantity determined provides a per cylinder torque value required to meet requested engine power and to provide acceptable emissions characteristics. In step 464, the fuel quantity is injected.

Figure 9:
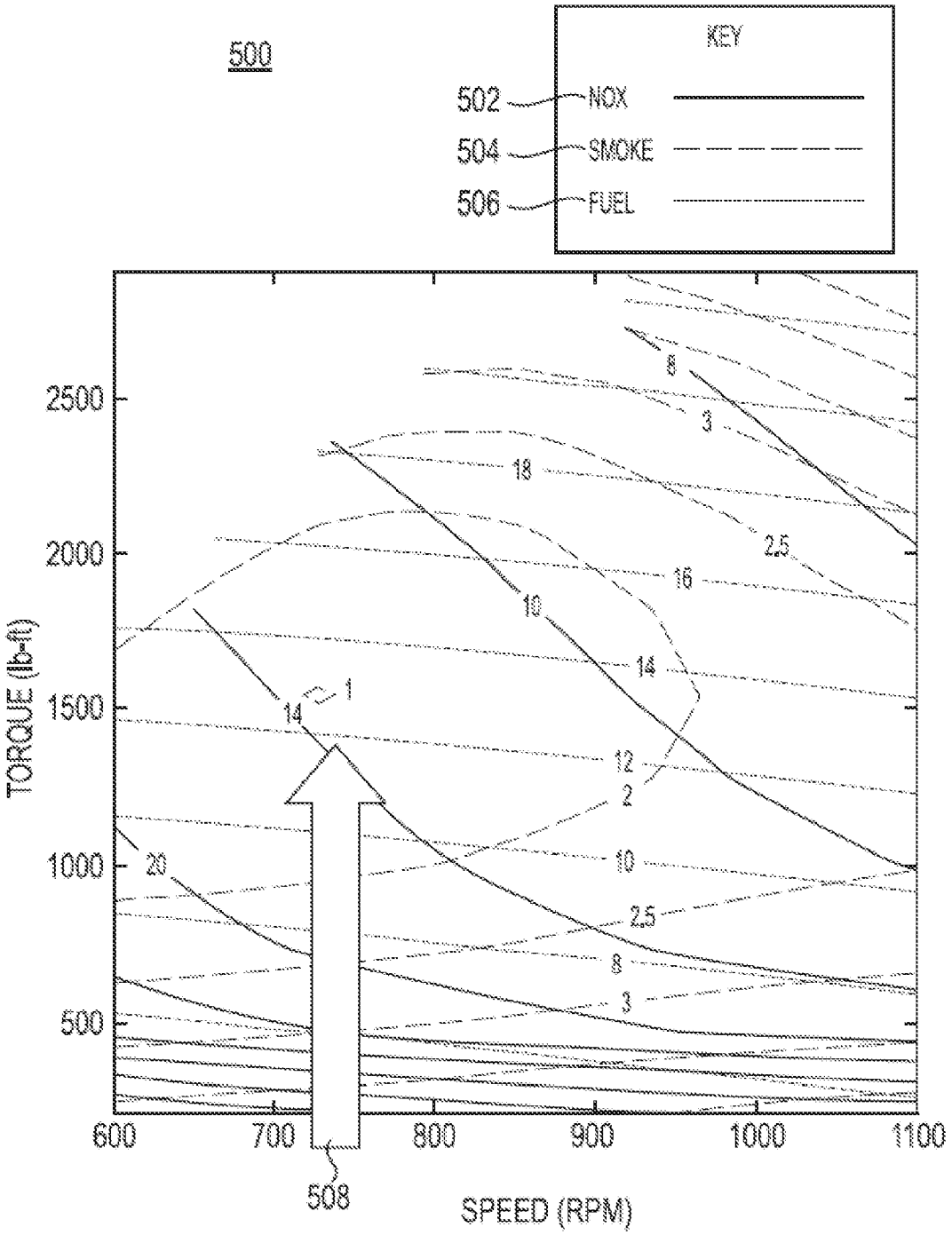
FIG. 9 is an exemplary illustration of a table for using engine parameters to select a number of cylinders deactivated, according to some embodiments of the disclosure.

FIG. 9 is an exemplary illustration of a table 500 for using engine parameters to select a number of cylinders to fire, according to some embodiments. The numbers shown are normalized from measurements. Table 500 can be used with method 400, for example. As shown, table 500 includes engine speed (i.e. revolutions per minute or rpm) along an X-axis and a per cylinder torque (i.e. lb-ft) along a Y-axis with several gradient curves. The intersection of engine speed and per cylinder torque represents a cylinder operating point.

Estimated $NO_x$ emission is represented by $NO_x$ gradient curves 502. Estimated smoke value values are represented by smoke gradient curves 504. Fuel injection quantity data is represented by fuel gradient curves 506. Data representing the gradient curves may be stored in one or more tables on a memory on an engine controller, for example.

For the sake of explanation, assuming the $NO_x$ emission threshold is 14 and the smoke emission threshold is 2, table 500 illustrates that for an engine speed 508 (approximately 725 RPM), the engine system is configured so that each engine cylinder is capable of producing about 1400 torque or more while producing an estimated $NO_x$ emission less than the $NO_x$ emission threshold. Each engine cylinder is also capable of producing between about 900 and 2100 lb-ft torque while producing an estimated smoke value less than the smoke value threshold of 2. Therefore, each engine cylinder, to meet both thresholds, must operate between a range of torques from 1400 and 2100 lb-ft. When operator requests only 725 RPM at a per cylinder load of 750 lb-ft torque, the engine system will produce emissions outside of the acceptable emission thresholds.

Upon detecting this condition, the engine system can selectively deactivate cylinders. For example, half of the engine cylinders may be deactivated. The system may further respond by increasing fuel injection quantity to double torque for each engine cylinder. At 725 RPM, or engine speed 508, doubling the torque to 1500 lb-ft per cylinder results in a fueling quantity at approximately 13 per cylinder. At this cylinder operating point, the engine system is able to produce emissions within acceptable emission thresholds.

Figure 10:
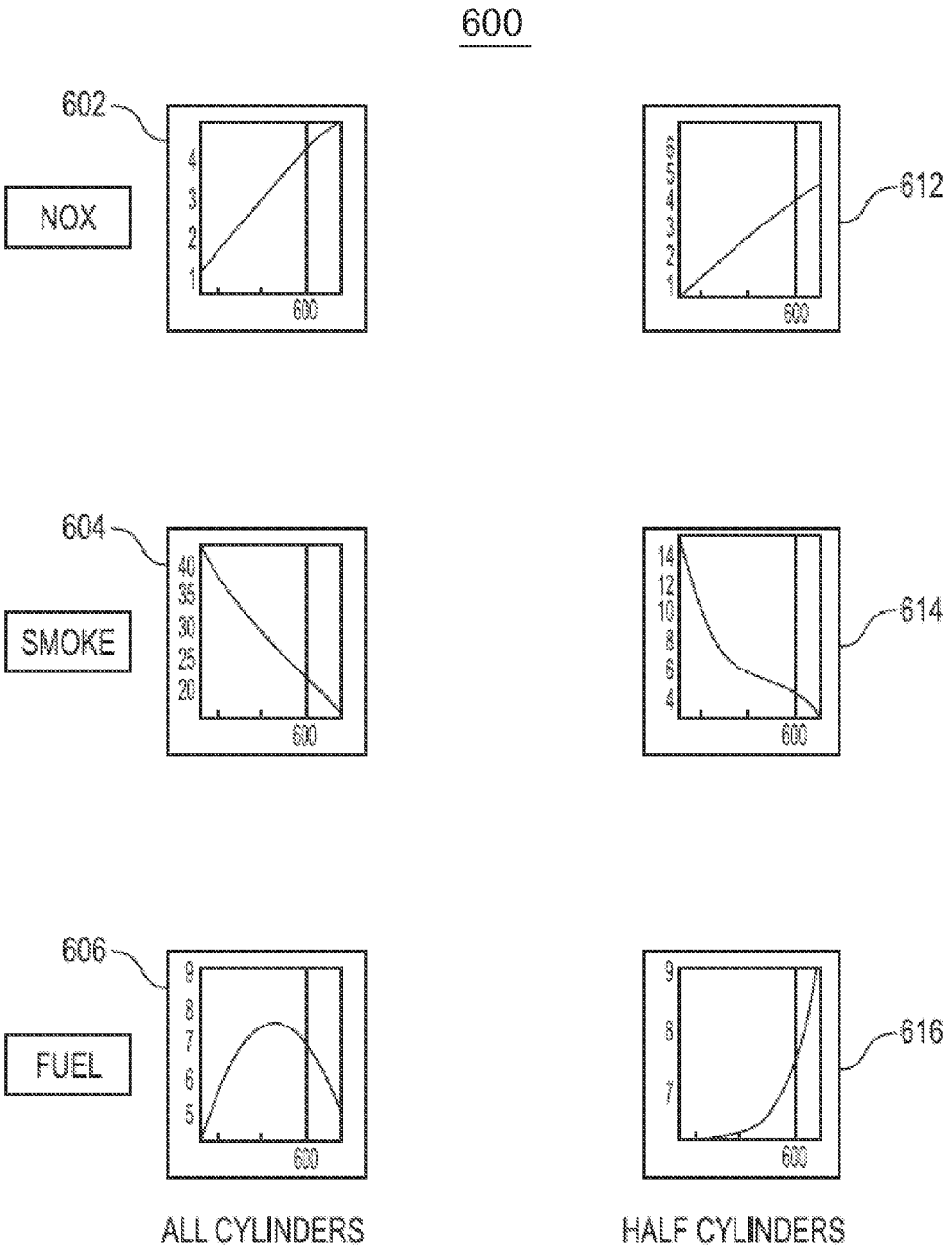
FIG. 10 is an exemplary illustration of tables comparing characteristics of an engine system operating with all cylinders firing versus an engine system operating with a selected number of cylinders deactivated, according to some embodiments of the disclosure.

FIG. 10 is an exemplary illustration of tables 600 comparing characteristics of an engine system 10 operating with all cylinders firing versus the engine system 10 operating with a selected number of cylinders to fire, according to some embodiments. As shown, tables 600 show characteristics of an engine system responding to a requested engine load of about 600 lb-ft of torque normalized from measured values. $NO_x$ emission 602, smoke value 604, and fuel per cylinder 606 are shown for an engine system firing all cylinders. $NO_x$ emission 612, smoke value 614, and fuel per cylinder 616 are shown for the same engine system with half of the cylinders selectively deactivated and firing the half of the total cylinders. The tables 600 show that selectively deactivating half of the cylinders significantly reduces smoke value 614 to about 5 at 600 lb-ft of torque from a smoke value 604 of about 20 at 600 lb-ft of torque when all cylinders are firing. However, the $NO_x$ emission 602, 612 are similar at about 4, which may correspond to an acceptable $NO_x$ emission, and fuel per cylinder 606, 612 are also similar at about 7.

We claim:

1. A method of operating an engine system, comprising:

detecting one or more engine system parameters, wherein the one or more parameters include at least one of an engine load and an engine speed;

selecting a number of engine cylinders to fire and a fuel injection quantity per selected engine cylinder in response to the one or more engine system parameters such that a nitrogen oxides ($NO_x$) emission is less than a first predetermined threshold and a smoke value is less than a second predetermined threshold, wherein selecting the number of engine cylinders to fire and the fuel injection quantity comprises:

determining a requested engine power;

calculating an estimated $NO_x$ emission and an estimated smoke value;

determining the first and second thresholds;

determining available numbers of cylinders to fire;

determining acceptable cylinder operating points based on the estimated $NO_x$ emission, estimated smoke value, first and second thresholds, and available firing patterns; and selecting a cylinder operating point and corresponding number of cylinders to fire and fuel injection quantity to meet the requested engine power; and operating the engine system with the selected number of engine cylinders to fire at the fuel injection quantity per selected engine cylinder.

2. The method of claim 1, wherein the one or more engine system parameters comprise at least one of: engine speed, engine load, instantaneous air-fuel ratio of firing engine cylinders, a fuel injection quantity versus engine speed curve defined in a controller, exhaust port temperature, engine operating state, and which module controls engine operation.

3. The method of claim 1, wherein the selected number of engine cylinders is less than a total number of engine cylinders such that a complementary number of engine cylinders are deactivated, further including calculating an estimated $NO_x$ emission and an estimated smoke value based on fresh air blow out from the deactivated engine cylinders.

4. The method of claim 3, wherein the selected fuel injection quantity per selected engine cylinder is higher than a nominal fuel injection quantity per engine cylinder, corresponding to firing all cylinders, such that injector spray characteristics for the selected engine cylinders are improved.

5. The method of claim 4, further including selecting a firing pattern for the engine cylinders to fire, wherein operating the engine system includes using the selected firing pattern.

6. The method of claim 1, wherein operating the engine system includes using a four-stroke engine cycle, the engine system being a high power engine.

7. The method of claim 1, wherein the engine system includes a high-pressure, injection system with high-capacity fuel injectors each having a nozzle sac volume adapted to produce acceptable smoke values at a typical engine operating point.

8. The method of claim 1, wherein the engine speed is higher than an idle engine speed.

9. A high power engine system, comprising:

a high-pressure injection system including injectors having a nozzle sac volume adapted to produce acceptable smoke values at a typical engine operating point;

a four-stroke diesel engine block including engine cylinders for receiving a fuel spray from the injectors; and means coupled to the high-pressure injection system for selecting a number of engine cylinders to fire and a fuel injection quantity per selected engine cylinder in response to one or more engine system parameters such that a nitrogen oxides ($NO_x$) emission is less than a first predetermined threshold and a smoke value is less than a second predetermined threshold, wherein selecting the number of engine cylinders to fire and the fuel injection quantity comprises:

determining a requested engine power;

calculating an estimated $NO_x$ emission and an estimated smoke value;

determining the first and second thresholds;

determining available numbers of cylinders to fire;

determining acceptable cylinder operating points based on the estimated $NO_x$ emission, estimated smoke value, first and second thresholds, and available firing patterns; and selecting a cylinder operating point and corresponding number of cylinders to fire and fuel injection quantity to meet the requested engine power.

10. The system of claim 9, wherein the one or more engine system parameters comprise at least one of: engine speed, engine load, instantaneous air-fuel ratio of firing engine cylinders, a fuel injection quantity versus engine speed curve defined in a controller, exhaust port temperature, engine operating state, and which module controls engine operation.

11. The system of claim 9, wherein the means for selecting further includes means for responding to dynamic changes in the one or more engine system parameters, including engine speed.

12. A controller for an engine system, comprising:

an engine description module configured to receive one or more engine system parameters, wherein the one or more engine parameters includes at least one of engine load and engine speed;

a combustion control module configured to provide control signals to components of the engine system, including a fuel injection system;

a data storage module configured to store tables, the tables including at least the first and second predetermined thresholds; and a processor operatively coupled to the engine description module, the combustion control module, and the data storage module, the processor configured for selecting a number of engine cylinders to fire and a fuel injection quantity per selected engine cylinder in response to the one or more engine system parameters such that a nitrogen oxides ($NO_x$) emission is less than the first predetermined threshold and a smoke value is less than the second predetermined threshold, wherein selecting the number of engine cylinders to fire and the fuel injection quantity comprises:

determining a requested engine power;

calculating an estimated $NO_x$ emission and an estimated smoke value;

determining the first and second thresholds;

determining available numbers of cylinders to fire;

determining acceptable cylinder operating points based on the estimated $NO_x$ emission, estimated smoke value, first and second thresholds, and available firing patterns; and selecting a cylinder operating point and corresponding number of cylinders to fire and fuel injection quantity to meet the requested engine power.

13. The controller of claim 12, wherein the one or more engine system parameters comprise at least one of: engine speed, engine load, instantaneous air-fuel ratio of firing engine cylinders, a fuel injection quantity versus engine speed curve defined in a controller, exhaust port temperature, engine operating state, and which module controls engine operation.

14. The controller of claim 12, wherein when the selected number of engine cylinders is less than a total number of engine cylinders such that a complementary number of engine cylinders are deactivated, the processor is further configured for calculating an estimated $NO_x$ emission and an estimated smoke value based on fresh air blow out from the deactivated engine cylinders.

15. The controller of claim 14, wherein the selected fuel injection quantity per selected engine cylinder is higher than a nominal fuel injection quantity per engine cylinder, corresponding to firing all cylinders, such that injector spray characteristics for the selected engine cylinders are improved.

16. The controller of claim 15, further including selecting a firing pattern as a function of the one or more engine and the selected number of engine cylinders to fire, wherein operating the engine system includes using the selected firing pattern.

17. The controller of claim 16, wherein the combustion control module is configured to provide control signals for a four-stroke engine cycle, the engine system being a high power engine.

18. The controller of claim 12, wherein the combustion control module is configured to send control signals to a high-pressure injection system, the high-pressure injection system including high-capacity fuel injectors each having a nozzle sac volume.

19. The controller of claim 12, wherein the engine speed is higher than an idle engine speed.

20. A method of operating an engine cylinder, comprising:

determining whether to fire an engine cylinder in response to one or more engine system parameters;

determining a fuel injection quantity for the engine cylinder such that a nitrogen oxides ($NO_x$) emission for the engine cylinder is less than a first predetermined threshold and a smoke value for the engine cylinder is less than a second predetermined threshold, wherein determining the fuel injection quantity comprises:

determining a requested engine power;

calculating an estimated $NO_x$ emission and an estimated smoke value;

determining the first and second thresholds;

determining available numbers of cylinders to fire;

determining acceptable cylinder operating points based on the estimated $NO_x$ emission, estimated smoke value, first and second thresholds, and available firing patterns; and selecting, a cylinder operating point and corresponding number of cylinders to fire and fuel injection quantity to meet the requested engine power; and injecting the fuel quantity into the engine cylinder.

21. The method of claim 20, wherein the one or more engine system parameters comprise at least one of: engine speed, engine load, instantaneous air-fuel ratio of firing engine cylinders, a fuel injection quantity versus engine speed curve defined in a controller, exhaust port temperature, engine operating state, and which module controls engine operation.

22. The method of claim 21, wherein the engine speed is above an idle engine speed.

23. The method of claim 20, wherein determining the fuel injection quantity is based on a selected number of cylinders to fire and a requested engine power.

24. The method of claim 20, further comprising injecting the fuel injection quantity into the engine cylinder from an injector having a nozzle sac volume, the fuel being injected at high pressure.

* * * * *